United States Patent [19]

Shoemaker

[11] Patent Number: 4,731,541

[45] Date of Patent: Mar. 15, 1988

[54] ULTRAVIOLET LIGHT FOR USE IN SETTING GELS FOR ARTIFICIAL FINGERNAILS

[75] Inventor: Richard E. Shoemaker, Milford, Conn.

[73] Assignee: Conair Corporation, Edison, N.J.

[21] Appl. No.: 889,241

[22] Filed: Jul. 25, 1986

[51] Int. Cl.[4] ..... G21K 5/08

[52] U.S. Cl. ..... 250/504 R; 250/492.1; 250/455.1

[58] Field of Search ..... 250/492.1, 504 R, 504 H, 250/454.1, 455.1; 132/73; 362/109

[56] References Cited

U.S. PATENT DOCUMENTS

| | | | |
|---|---|---|---|
| 2,461,695 | 2/1949 | McMahon | 132/73 |
| 3,928,113 | 12/1975 | Rosenberg | 132/73 |
| 4,596,260 | 6/1986 | Giuliano | 132/73 |
| 4,612,444 | 9/1986 | Ragusa | 250/492.1 |

FOREIGN PATENT DOCUMENTS

| | | | |
|---|---|---|---|
| 0201107 | 11/1986 | European Pat. Off. | 132/73 |
| 1128932 | 9/1956 | France | 132/73 |

*Primary Examiner*—Bruce C. Anderson
*Assistant Examiner*—Paul A. Guss
*Attorney, Agent, or Firm*—Haynes N. Johnson

[57] ABSTRACT

A light system for providing uniform actinic radiation to fingernails while in a predetermined position, including a generally ellipsoidal housing having a circular horizontal cross-section and reflective inner surfaces to concentrate light, the surfaces being so shaped and so dimensioned as to concentrate, in the predetermined position, the light rays from an ultraviolet lamp in the housing, an opening in the housing to receive the hand of a user, and means for guiding the user's hand so as to position the fingernails of the hand in the predetermined position, the guiding means including a handle to be grasped by the user and means interconnecting the handle and housing and controlling the position of the handle as it is moved within the housing. An adjustable timer may be provided to control exposure times.

18 Claims, 12 Drawing Figures

Fig. 1.
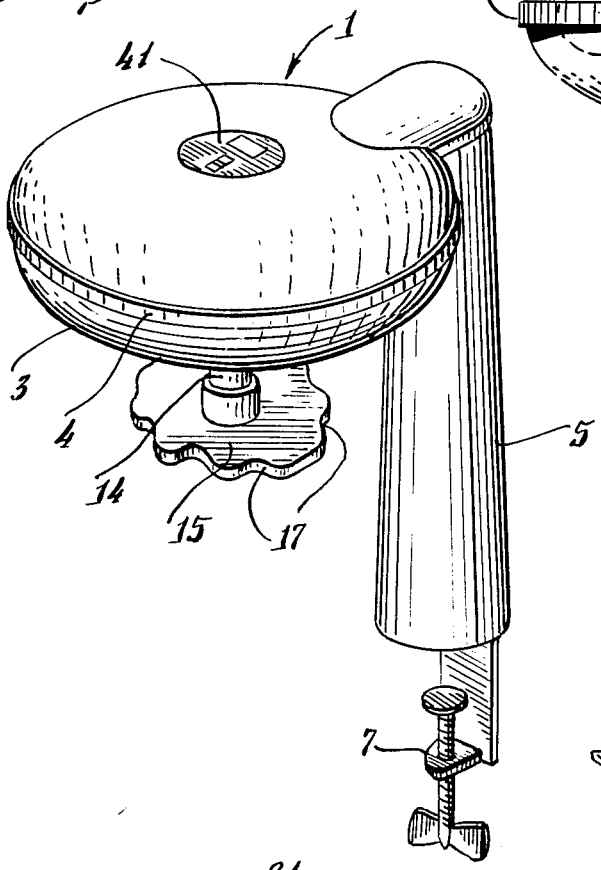
Fig. 2.
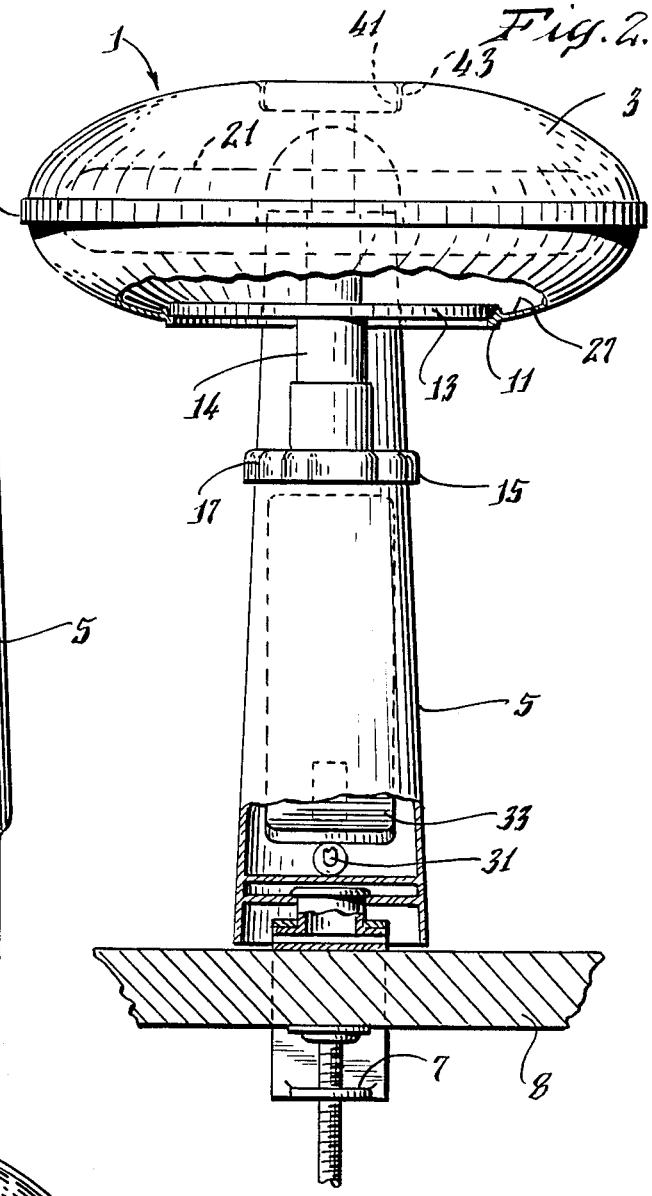
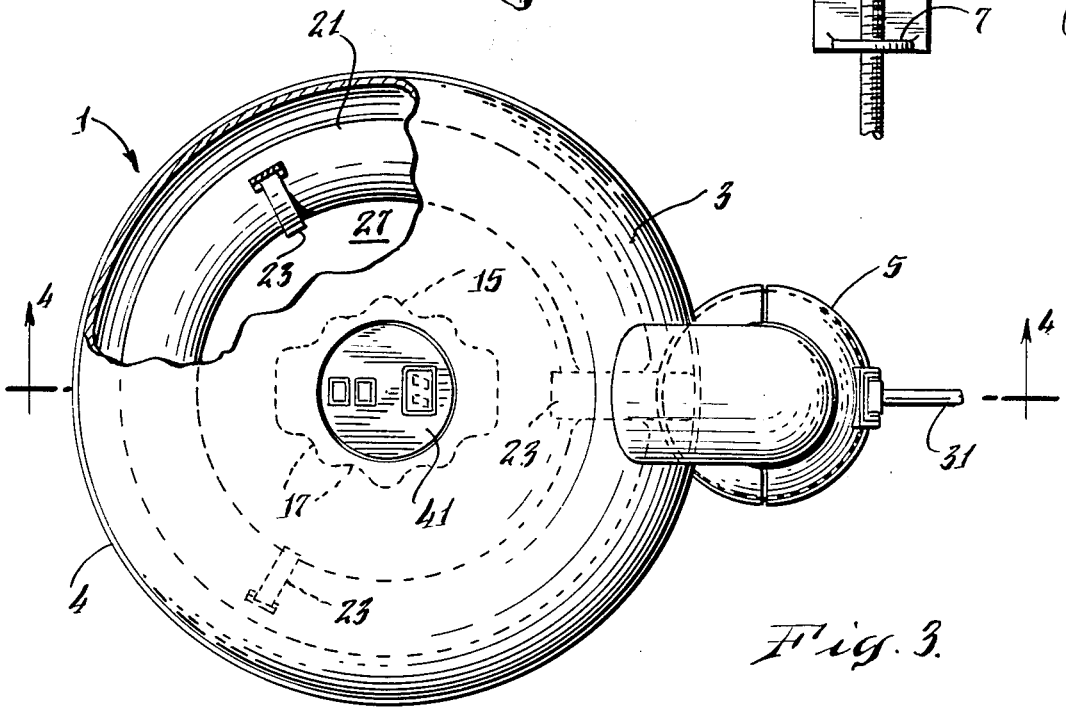
Fig. 3.

TWO DIGIT

FOUR DIGIT

ULTRAVIOLET LIGHT FOR USE IN SETTING GELS FOR ARTIFICIAL FINGERNAILS

FIELD OF THE INVENTION

This invention relates to the field of ultraviolet lights so designed as to efficiently set gels used with fingernails. The gels are of the type which are photocurable and, when subjected to actinic radiation such as ultraviolet light, form polymers which resemble natural fingernails. It is best, for this use, that the light be evenly distributed over the nails being treated so that the gels will set uniformly.

RELATED APPLICATIONS

The ultraviolet light of this invention is usable in systems such as those disclosed in Giuliano U.S. Pat. No. 4,596,260, issued June 24, 1986, on Artificial Nails, and Giuliano application 522,536, filed Aug. 12, 1983, on Novel Process And Article For Preparing Artificial Nails, and the divisional thereof. This patent, the applications, and this application are ownedby a common assignee.

BRIEF SUMMARY OF THE INVENTION

Various systems exist for the creation of artificial fingernails or for the coating of natural or artificial nails. Among these are systems employing compositions which are photocurable, by visible or ultra-violet light, to form hard polymers resembling natural nails. These compositions may be used to lengthen a natural nail, to secure a preformed artificial nail to the natural nail, or simply to coat a natural or artificial nail.

My light is not simply a standing lamp placed over the nails (with the hand palm down). For, as can be observed by placing the hand plam down and noticing the angle which the different nails, especially the thumb, make to the vertical, such a light of will not expose each of the nails uniformly. Rather, the light of this invention is designed to cause the user to hold her hand palm upward in an open grasping posture. With all the nails of the hand being at approximately the same angle to the vertical, and exposing the nails to ultraviolet light from multiple angles around to nails, complete and uniform exposure to the ultraviolet radiation occurs.

The ultraviolet light itself shines inwardly from around the horizontal circumference of an ellipsoid. It is concentrated in the are where the nails will be placed. The hand is positioned with the nails inside this circumference by having the user grasp a downwardly projecting handle secured to a displaceable door on the bottom surface of the ellipsoid and lifting it upwardly into the ellipsoid. The motion is guided to the correct position for the nails. This is a natural hand position and a natural motion, since the user is simply grasping a handle which serves to open the ellipsoidal light box. If desired, this motion may also serve to actuate a light switch and timer.

The use of a lower door also serves to keep the ultraviolet light within the housing. This is important because it minimizes exposure to ultraviolet glare to the eyes and lessens the exposure of ultraviolet light to containers of photocurable material being used on the makeup table.

Thus, the nails are exposed to the light as the fingers project into the interior of the light box; and, because of their angle to the ring of light, the fingernails are exposed uniformly.

DESCRIPTION OF THE DRAWINGS

FIG. 1 is a perspective view of my ultraviolet light. It shows an arm for securely mounting the light on a table, the ellipsoidal lamp housing, and the handle extending downwardly from the housing.

FIG. 2 is a front view (elevation) of the lamp, partially broken away to show some internal details.

FIG. 3 is a top view of the lamp, also partially broken away.

FIGS. 6 and 7 serve to show how the nails are positioned within the lamp housing for exposure to ultraviolet light.

FIG. 11 is a section taken on line 11—11 of FIG. 8.

DETAILED DESCRIPTION OF THE INVENTION

Figure 4:
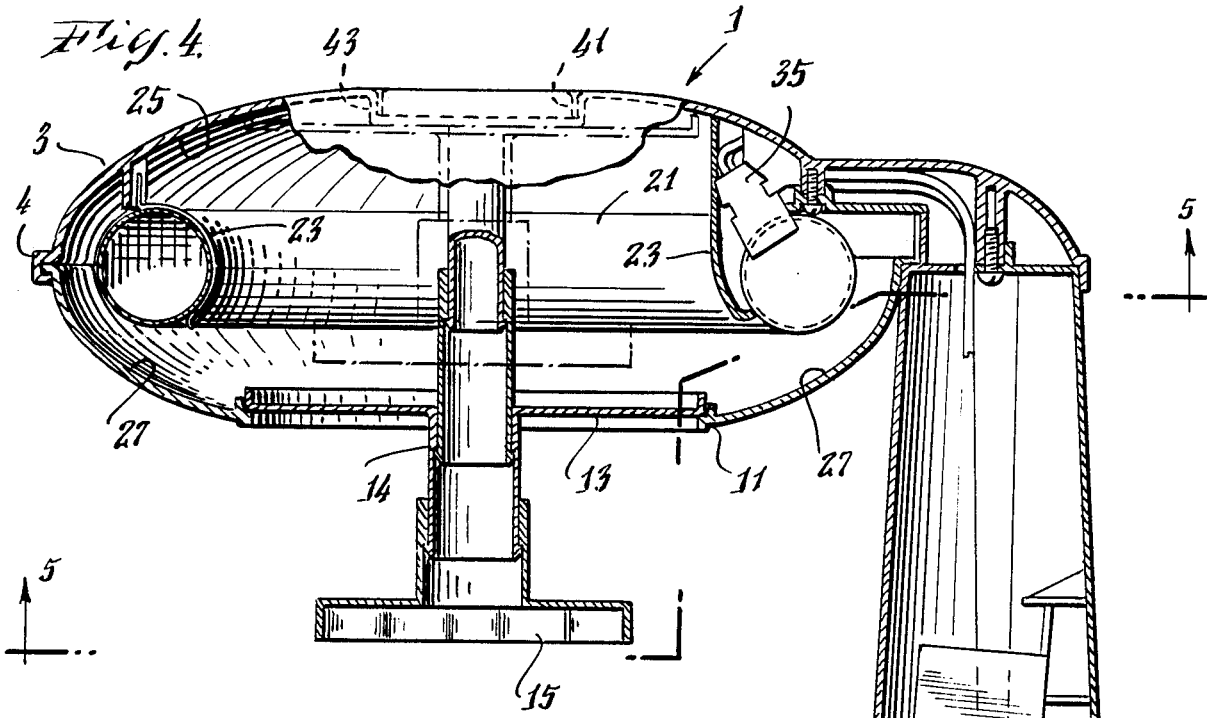
FIG. 4 is a vertical section of the lamp, taken on line 4—4 of FIG. 3, showing internal details of lamp structure.
Figure 4:
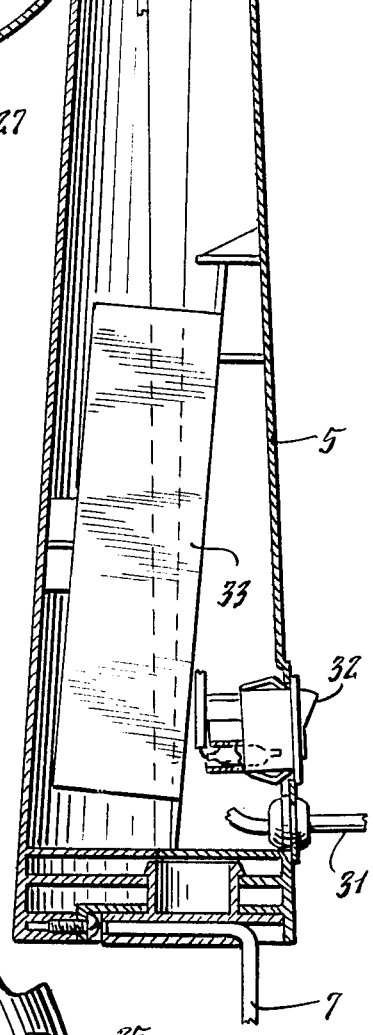
Figure 5:
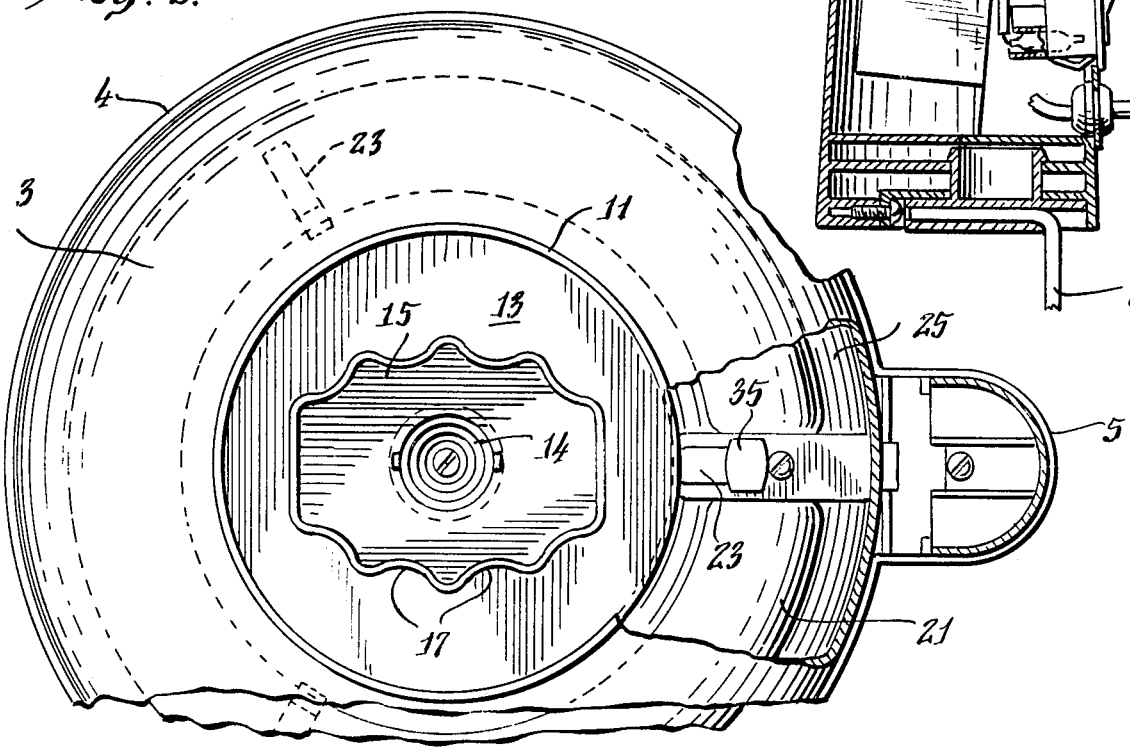
FIG. 5 is a horizontal section, partially broken away, taken on line 5—5 of FIG. 4.

The general configuration of my ultraviolet light 1 is shown in the perspective view of FIG. 1. The lamp housing is identified as 3. It is held by support arm 5 which has a clamp 7 at its base to secure the arm to the edge of a work table top 8. A handle 15, with finger indentations 17, is seen extending beneath housing 3.

Housing 3 is of generally ellipsoidal shape, but preferably is of circular horizontal cross-section. It may be formed of separate upper and lower halves joined at joinder line 4. The housing 3 has a circular opening 11 in its bottom, the opening being large enough to receive the user's hand. A door 13 rests upon the inner surface of the bottom opening 11, serving to close the housing. The door 13 has a telescoping shaft 14 extending downwardly to a generally horizontal handle 15; and handle 15 has a series of finger indentations 17 about its periphery spaced to receive the user's fingers 19 and position them about the handle 15.

Figure 7:
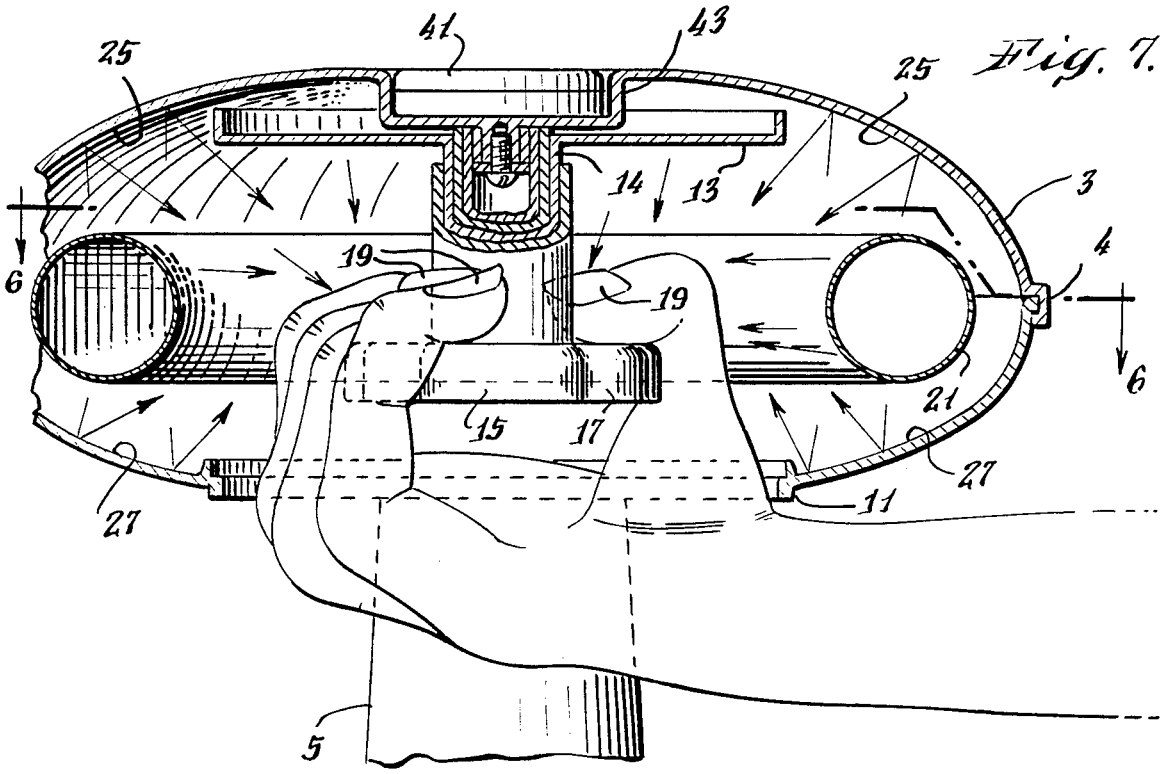
FIG. 7 is a vertical section through the lamp housing, showing the user's hand projecting within the housing while it grasps the handle.
Figure 8:
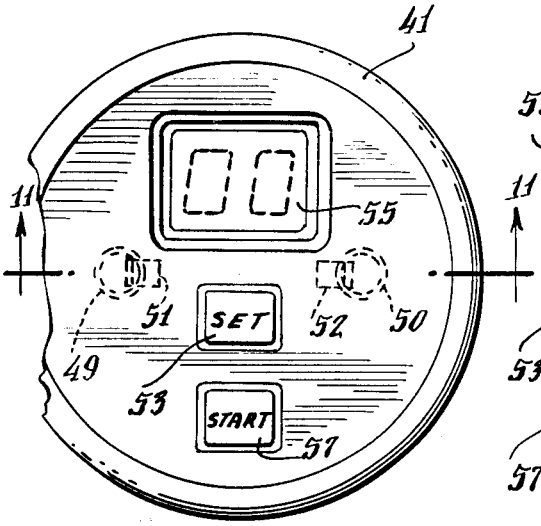
FIG. 8 is a partial plan view of the top of the housing showing the control switch insert for the light. This will be seen in FIGS. 1 and 3.
Figure 9:
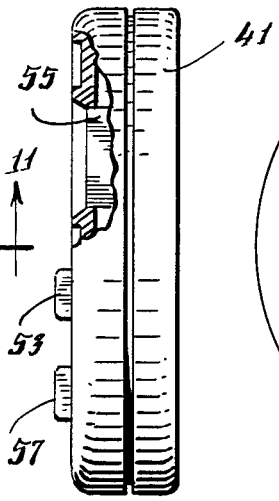
FIG. 9 is a side view of the inset of FIG. 8.
Figure 10:
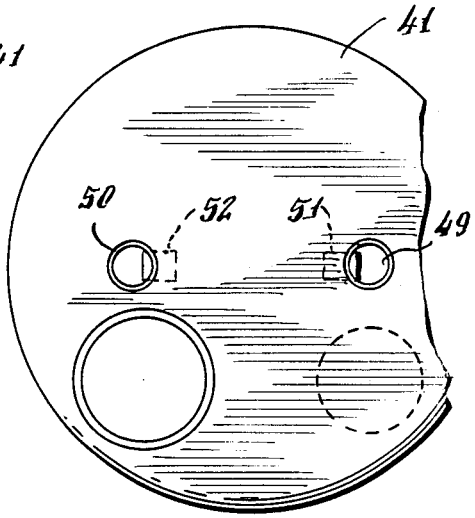
FIG. 10 is a bottom plan view of the control insert shown in FIG. 8.
Figure 11:
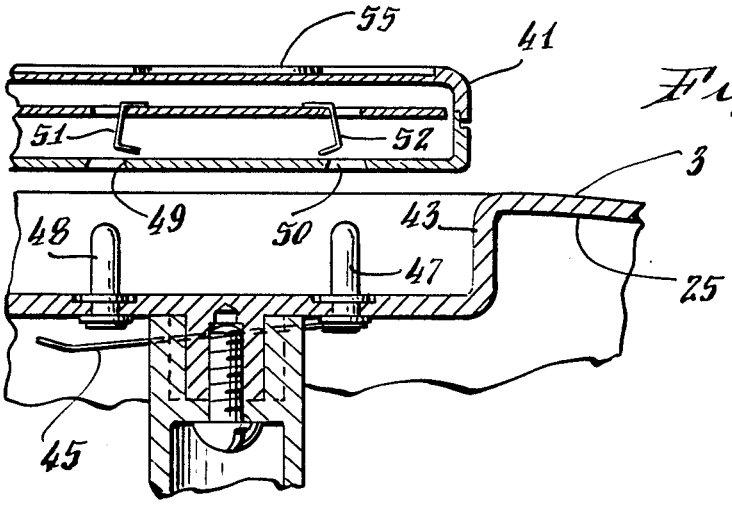
FIG. 11 is a sectional view of the insert of FIG. 8 as it is being placed within a recess in the top of the housing.

The shaft 14 connects handle 15 with door 13 and supports the handle 15. Shaft 14 continues upwardly above door 13 and is secured to the upper inner surface of the housing, normally being secured to the lower surface of the recess 43. Shaft 14 should telescope above and below door 13. This will permit the user to put her hand fully into housing 3 without the door pressing against the inner top surface of the housing 3 and preventing further movement of handle 15. The position of handle 15 when within housing 3 is shown in phantom in FIG. 4. The handle 15 and the telescoped shaft 14 are shown in FIG. 7. As seen in FIG. 7, door 13 presses against the bottom of recess 43; this can be used for electrical control, as described below.

A circular ultraviolet light 21, the source of actinic radiation, is positioned within housing 3 with mounting brackets 23. The light is of a size and diameter to fit within housing 23 horizontally and to be proximate to the inner horizontal circular circumference. The light may emit either ultraviolet or visible light, and be incandescent or fluorescent; but, preferably it is an ultraviolet fluorescent lamp. The electricity for the lamp comes from inlet electrical cord 31, through switch 32 and ballast 33, in arm 5, to light socket 35. As described below, it may also be subject to timing control through insert 41.

The inner surfaces of housing 3 are curved to provide maximum reflectivity of radiation from the light 21 to the fingernails 19. Thus, for example, inner upper surface 25 and inner lower surface 27 of housing 3 may have a vertical shape in radial section approximating that of a parabola. The light 21 is so positioned relative to the focus point of the parabolic section that it serves to concentrate or focus the light's radiation upon the approximate position of fingernails 19 as the user grasps handle 15 within bottom opening 11 and inside the housing 3. This is shown by the arrows in FIGS. 6 and 7.

Figure 6:
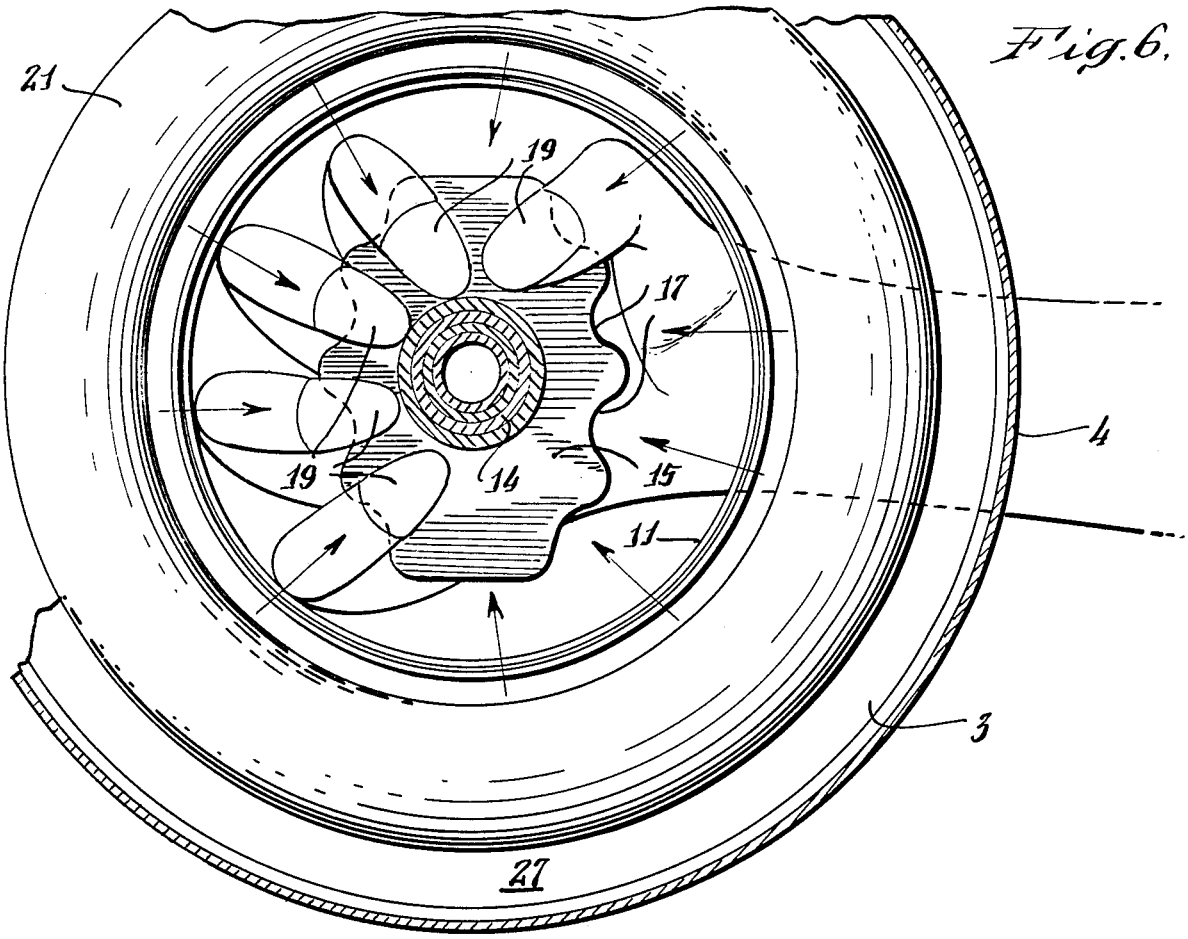
FIG. 6 is a horizontal section through the lamp, viewed from above, showing a user's hand grasping the handle and within the lamp housing so as to expose the fingernails to ultraviolet light.

It will be observed that the position of the hand in FIGS. 6 and 7 is with the palm upward and the fingers grasping handle 15. Preferably, the fingers also fall within indentations 17. The result of this positioning is that all of the fingernails 19 are at approximately the same angle to the vertical, and so they receive uniform exposure to the actinic radiation from ultraviolet light 21. It will be noted that the telescoping shaft 14 serves to guide the handle as it is moved inwardly, and so serves to guide the user's hand to the desired position.

The more uniform exposure obtained is believed to be superior to that obtained with the usual lamp which simply projects light downwardly to where the hand is resting palm down on a surface.

It is desirable for the lamp 21, the handle 15, and the closure member 13 to be so dimensioned and so positioned relative to one another as to cause the user's fingernails to receive uniform exposure to the rays of the lamp. This uniformity can be enhanced by the shape of the inner reflective surfaces 25 and 27 relative to the position of the lamp and the fingernails.

Lamp 1 may also include timing circuits so that the gel may be subjected to ultraviolet light for a predetermined number of seconds. These circuits may also include means for automatically turning on the light 21 when the user's hand enters the housing 3.

One method of accomplishing the turning on is to mount a leaf spring contact arm 45 on the lower surface of recess 43 so that upward pressure from door 13, pressed upwardly by the user, will connect two electrical pins 47 and 48, closing a circuit.

A better method is to utilize the pins 47 and 48 to not only start the unit, but also to start a timing circuit. This is done through use of control insert 41, positioned in recess 43. Insert 41 is provided with two vertical holes 49 and 50 which carry contacts 51 and 52 and receive pins 47 and 48. Now when door 13 is pressed upwardly a circuit will be closed within insert 41.

Insert 41 includes a timing circuit which may be preset to leave the total circuit closed, and so the light on, for a predetermined number of seconds. The timing circuit has a built-in memory to simplify the timing function. To set the timer, one presses the "set" button 53 and hold it until the digital display 55 reaches the desired number of seconds. The internal circuitry is such that when the circuit is closed between contacts 51 and 52, the light 21 will be on for the set number of seconds. The circuit may also provide for an audible signal when the timing cycle is complete. If desired, a "start" button 57 may also be provided which must be pressed to begin the cycle. In such a case, contact arm 45 acts as an interlock rather than a start switch.

Figure 12:
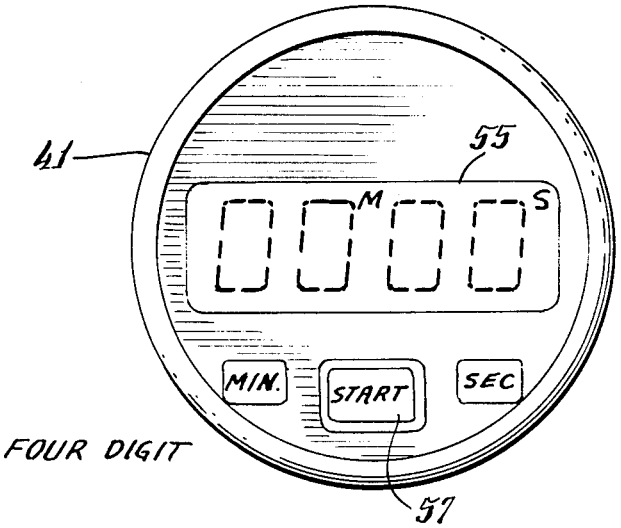
FIG. 12 is a top plan view of a modified control insert similar to that of FIG. 8.

A modified control insert 59 is shown in FIG. 12. This operates similarly to insert 41, but includes setting and adjustments for both minutes and seconds.

When using the lamp of my invention, one applies the appropriate gel to the fingernails, for coating, for building a nail extension, or for securing a preformed artificial nail to a natural nail. Handle 15 is grasped (palm upwardly, as one must), and the handle is raised. This uncovers bottom opening 11 and the hand moves into housing 3, with the fingernails facing upwardly as in FIGS. 6 and 7. Shaft 14 telescopes to allow this movement. When door 13 reaches contact arm 45, the circuit is closed and either starts light 21 or, if the timing circuit is being used, starts the light and the timer. After the correct exposure, the gel should be set, and the light then goes off.

As an alternative when using fluorescent light, the user could leave the light source on continually, and the exposure would be limited by (1) pushing the handle 15 up into housing 3 (2) timing the period in that position and then (3) pulling the handle out of the housing. This would avoid the brief warmup period required to cause the fluorescent lamp to come up to full ultraviolet output.

I claim:

1. A light source for curing gel on fingernails and providing uniform radiation levels thereto, said light source including a housing having lamp means therein for treating said gel, said lamp means emitting ultraviolet rays, support means for said housing, a closure member, said housing including an opening therein on the bottom of said housing to receive said closure member and to retain said closure member within said housing means for mounting said closure member for vertical movement within said housing and upwardly from said opening, and a handle secured to said closure member and positioned to be grasped by the user's hand and moved inwardly of said housing, wherein grasping said handle and moving it inwardly serves to bring the user's fingernails into said housing and to allow them to be exposed to said rays from said lamp means.

2. A light source as set forth in claim 1 in which said lamp means, said handle, and said closure member are so dimensioned and so positioned relative to one another such that said lamp means is above and surrounding said fingernails when said handle is grasped and moved inwardly and upwardly wherein said fingernails are positioned to receive substantially uniform exposure to the rays of said lamp means.

3. A light source as set forth in claim 1 in which said housing is generally ellipsoidal.

4. A light source as set forth in claim 1 including a switch mounted within said housing and so positioned as to be actuated by contact with said closure member, wherein grasping said handle and moving it inwardly toward said housing will serve to operate said lamp means.

5. A light source as set forth in claim 1 including a timer operatively associated with said lamp means.

6. A light source as set forth in claim 1 including a timer for said lamp means, and said timer being operatively associated with said closure member, wherein predetermined movement of said closure member serves to actuate said timer.

7. A light source as set forth in claim 4 including a timer operatively associated with said switch, wherein actuation of said switch starts said timer.

8. A system for positioning one's hand during exposure of the fingernails to actinic radiation such that said fingernails receive substantially uniform radiation, said systems including a light source, a housing therefor, said light source being positioned on the upper inner surface of said housing, a member associated with said housing to be grasped and moved by the hand, and means for guiding motion of said member upwardly and vertically within said housing wherein said fingernails are positioned approximately in the point of concentration of said light source.

9. A system as set forth in claim 8 in which said member is telescopingly secured to the inner surface of said housing.

10. A system as set forth in claim 8 in which said housing has reflective inner surfaces, and said surfaces are so shaped as to concentrate said light source upon said point of concentration.

11. A system as set forth in claim 10 in which said housing has a generally ellipsoidal shape.

12. A system as set forth in claim 8 including a timer for timing said exposure.

13. A system as set forth in claim 12 in which said timer is actuated by said guiding means.

14. A light system for providing actinic radiation to fingernails on a user's hand and for positioning said fingernails to receive said radiation, said system including a generally ellipsoidal housing having a circular horizontal cross-section, support means for said housing, a circular, ultraviolet lamp means positioned within said housing in a horizontal plane proximate to the upper surface thereof, said housing having reflective inner surfaces, said surfaces being so shaped and so dimensioned relative to the position of said lamp means as to concentrate the light rays from said lamp means in a predetermined location, an opening in said housing to receive said user's hand, and means for guiding the user's hand vertically upwardly within said housing so as to position the fingernails of the hand in said predetermined position, wherein said fingernails may receive substantially uniform exposure to said light rays.

15. A light system as set forth in claim 14 including timing means associated with said lamp for controlling the time of exposure of said fingernails to said light rays.

16. A light system as set forth in claim 15 wherein said timing means includes means for setting said timing means for providing differing exposure times.

17. A light system as set forth in claim 14 in which said guiding means includes a handle to be grasped by the user and means for interconnecting said handle and said housing and controlling the position of said handle as it is moved within said housing.

18. A light system as set forth in claim 17 in which said interconnecting means is a telescoping shaft connecting said handle to one of said inner surfaces of said housing.

* * * * *